United States Patent [19]

Fayle

[11] 4,093,285

[45] June 6, 1978

[54] WINDOW LOCK

[76] Inventor: Paul R. Fayle, P.O. Box 1121, Lexington, Va. 24450

[21] Appl. No.: 668,002

[22] Filed: Mar. 18, 1976

[51] Int. Cl.[2] ..... E05C 5/04

[52] U.S. Cl. ..... 292/251; 85/50 R

[58] Field of Search ..... 292/251, 45; 85/50; 151/37

[56] References Cited

U.S. PATENT DOCUMENTS

| | | | |
|---|---|---|---|
| 188,112 | 3/1877 | Ekerman | 292/251 |
| 601,369 | 3/1898 | Casey | 292/251 X |
| 710,896 | 10/1902 | Samson | 292/251 |
| 1,382,758 | 6/1921 | Brown | 292/251 |
| 1,528,473 | 3/1925 | Edwards | 292/251 |
| 1,553,318 | 9/1925 | Lander | 292/251 |
| 1,639,661 | 8/1927 | Newcomb | 292/251 |
| 1,943,691 | 1/1934 | Nachtrieb | 292/251 X |
| 1,978,781 | 10/1934 | Berger | 70/404 X |
| 2,120,788 | 6/1938 | Riccelli | 292/251 |
| 2,210,455 | 8/1940 | Hosking | 151/37 |
| 2,715,929 | 8/1955 | Knohl | 151/37 |
| 3,060,785 | 10/1962 | Corlett et al. | 85/9 R |
| 3,288,510 | 11/1966 | Gough et al. | 292/251 |
| 3,389,734 | 6/1968 | Gutshall | 151/37 |
| 3,519,979 | 7/1970 | Bodenstein | 85/45 X |
| 3,859,888 | 1/1975 | Okada | 85/45 |

FOREIGN PATENT DOCUMENTS

| | | | |
|---|---|---|---|
| 19,355 | 10/1892 | United Kingdom | 292/251 |
| 1,006,102 | 9/1965 | United Kingdom | 151/14 DW |

*Primary Examiner*—Richard E. Moore

*Attorney, Agent, or Firm*—Lowe, King, Price & Markva

[57] ABSTRACT

A screw lock assembly is provided for sash windows. The lock comprises a self-tapping screw for insertion into aligned apertures formed in the abutting frame members of the window. The aligned apertures are open at one end adjacent the inside of the window and the inner aperture has a substantially enlarged portion at the open end. A cup washer is countersunk by positioning in the enlarged portion and the head and flat washer of the screw is recessed into the cup washer to limit accessibility to the head when the screw lock is in the operative position. Circular ridges are formed on the underside of the flat washer and serve as a locking means by frictionally engaging the adjacent face of the cup washer. The head and flat washer is integral with the screw and the head is made tamper-proof by the act that it is a cylinder with a single, substantially ninety degree flattened side. A key is provided having a corresponding outline for driving the screw. A spaced aperture may be provided to provide a locked, slightly open position of the windows, if desired. In an alternative embodiment, the cup washer is not countersunk.

1 Claim, 7 Drawing Figures

WINDOW LOCK

FIELD OF THE INVENTION

The present invention relates to window locks, and more particularly relates to locks for use primarily when occupants of the building are away and as a supplement to conventional locks.

BACKGROUND OF THE INVENTION

The problem of burglaries in the home has steadily increased over the last several years. The "modus operandi" of the typical suburb burglar has been found to fall into a definite pattern. This pattern is to canvass a neighborhood looking for houses where the occupants are away, usually on an extended vacation. When this has been determined, the burglars make the hit in the night with the entry usually being gained by breaking the pane of a sash window, reaching in and releasing the usual rotary lock, raising the window and climbing in through the window. Once inside, the house is ransacked for valuables and the burglar makes his exit, usually within 6–7 minutes, through the door or back through the open window.

There have been several suggested systems for providing supplemental locks to the windows for use primarily when the occupants of the building are away to deter these burglaries. One accepted method that is recommended by many police departments and other law enforcement agencies is very simple. It comprises drilling a hole through the abutting frame members of the sash windows and inserting a nail through the hole to hold the windows from sliding up or down.

This supplemental locking device has worked in some cases in the past, and is simple and inexpensive. But, it suffers the drawback that it is now easily detected by the burglar and once detected the nail or pin is easily removed manually. Then, access can still be obtained and the burglar completes his job within his allowed safe time.

There have been several suggestions for improved lock assemblies to overcome the shortcoming of the basic pin-type lock being too easy to defeat by the burglar. One of these prior art developments is described in the U.S. Pat. No. to Gough et al 3,288,510, issued Nov. 29, 1966. This patent involves utilizing a machine screw in place of the pin and an insert for the screw to engage in one of the sash members. This device, while also serving a purpose of providing an additional lock, is more expensive since the insert is required and the screw can normally be removed since the burglar usually has the most common tools, such as a screw driver, in his possession during his attempt at entry. By the simple act of removal of the screw, the burglar still meets his safe time requirement.

OBJECTIVES OF THE INVENTION

Thus, it is one object of the present invention to provide an improved screw lock assembly for sash windows wherein the assembly is not easily removable by the burglar, thus defeating the burglar's safe time, and effectively preventing the act, and the design is simple for low cost and easy installation.

Another object of the present invention is to provide a lock assembly wherein the screw directly engages the frame member and requires only an additional cup washer for maximum deterrent action.

Another object of the present invention is to provide a screw lock that has a built-in locking means to increase the difficulty of unauthorized removal.

BRIEF DESCRIPTION OF THE INVENTION

The screw lock assembly of my invention takes the form of a specially manufactured lag screw that fits within aligned apertures in abutting window sash frame members. The screw has self-tapping threads that directly engage the wooden part of the frame members in order to draw the screw into position and firmly clamp the frame members together.

At the inside end of the aligned apertures, an enlarged portion is provided and receives a specially designed cup washer. The cup washer is seated with a tight fit into the enlarged portion. The screw is provided with an integral flat washer and head that fits within the cup washer. The cup washer limits lateral access to the head of the screw so that grasping of the head, even with needle nose pliers, is virtually impossible.

To further thwart the attempts by a burglar to remove the screw lock of the present invention, the head of the screw is specially designed so that the common tools, such as the pliers mentioned and a screw driver, are ineffective to turn the screw and allow removal. The specially designed head may comprise a cylindrical body with a single flat side, the chord formed by the side extending across substantially ninety degrees of the head. It is understood that this particular head is the preferred embodiment, but that other heads can be designed for use with the basic principles of the present invention. Thus, in accordance with the broader aspects of the present invention, the specific design of the head is not material.

Since the screw is locked in the aperture against axial movement by the threads of the screw, attempts to pull it straight out are of course not effective, unlike the case with a nail or pin. Thus, the screw must be positively turned in order to remove it from the locking position. Because the head is recessed in the cup washer, a travel of at least three or four turns must be realized before the head can be manually grasped. In order to positively resist the turning action required to start the screw for removal, I have devised a simple, but effective locking means for the screw. The preferred embodiment of this locking means is a series of circular ridges formed on the underneath side of the flat washer on the screw. The ridges are designed to bite into the inside face of the mating cup washer and because of the tight fit of the cup washer in the recess, the turning of the screw is prevented.

A special key is provided to fit the tamper-proof head of the screw and an additional aperture may be provided for alignment with the aperture in the opposite frame member so that the windows may be locked in a slightly open or ventilate position, if desired.

In accordance with another embodiment, the cup washer need not be mounted in an enlarged aperture. Thus, the washer would be positioned on the face of the frame member of the window. The tight frictional engagement between the back of the cup washer and the face of the frame member resists the turning of the assembly by an unauthorized person. In this embodiment, as in the preferred embodiment, if the washer is turned, it will drive the screw only a limited amount and then start to slip. Once the washer starts to slip, the screw cannot be turned any further since the head is still surrounded by the cup thereby still limiting access to the screw head.

Still other objects and advantages of the present invention will become readily apparent to those skilled in this art from the following detailed description, wherein I have shown and described only the preferred embodiments of the invention, simply by way of illustration of the best modes contemplated by me of carrying our my invention. As will be realized, the invention is capable of other and different embodiments, and its several details are capable of modification in various obvious respects, all without departing from the invention. Accordingly, the drawings and description are to be regarded as illustrative in nature, and not as restrictive.

DETAILED DESCRIPTION OF THE DRAWINGS

Figure 1:
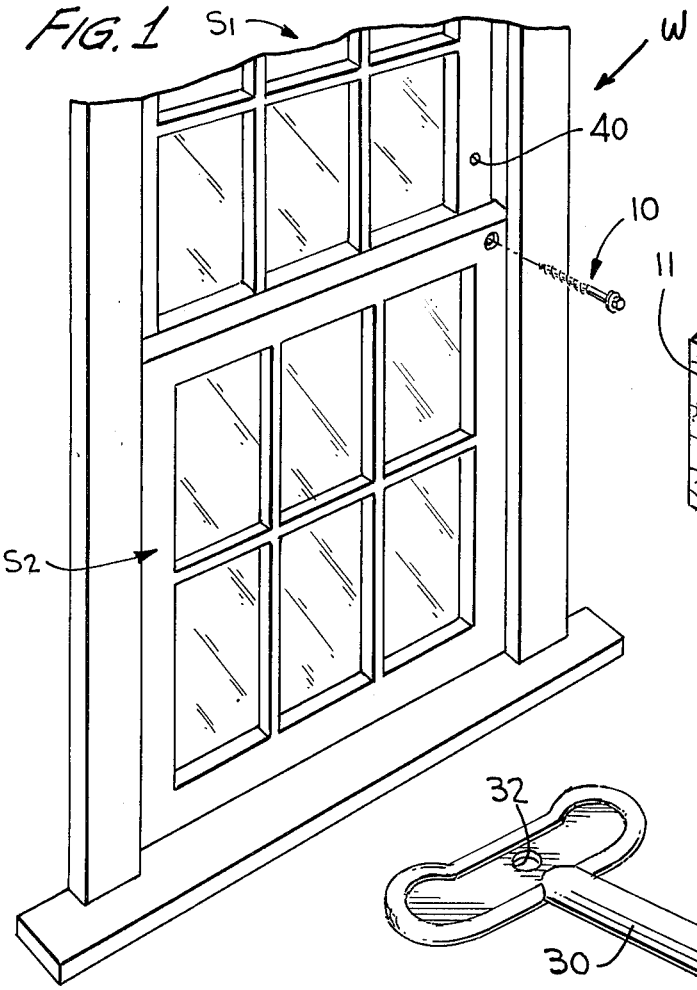
FIG. 1 is an overall perspective view showing a single screw lock assembly positioned relative to the window to be locked.

With reference now to FIG. 1 of the drawings, a window unit W is shown including upper and lower sash windows $S_1$, $S_2$. The sash windows may be of any conventional type including multiple panes of glass separated by cross pieces, as shown. A screw 10 (shown in FIG. 1, spaced outwardly from engagement with the sash $S_2$) is the basic part of the screw lock assembly of the present invention. While the screw lock of the invention is very well adapted to use with the sash-type window, as will be more fully understood from this description, it should be understood that other windows, such as windows that pivot about a vertical axis could also be locked and secured if desired.

Figure 2:
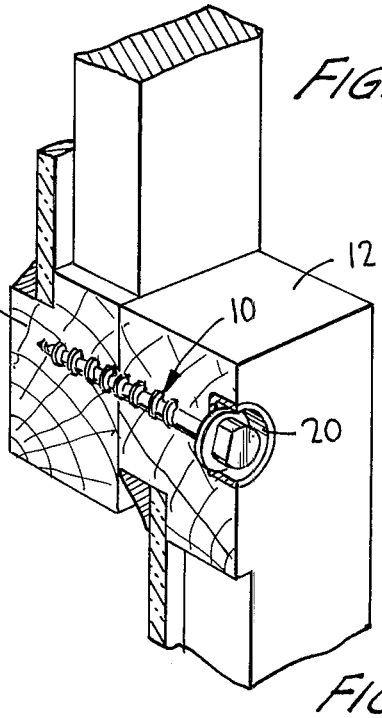
FIG. 2 is a perspective view in cross-section showing the screw lock installed in the locked position.

FIG. 2 shows a cross-sectional view in perspective taken through the area of the sashes $S_1$, $S_2$, where the assembly is installed. Outside frame member 11 overlaps the inside frame member 12 of the sashes $S_1$, $S_2$, respectively. The screw 10 is driven into aligned apertures in the frame members 11, 12, as shown in FIG. 2.

Figure 3:
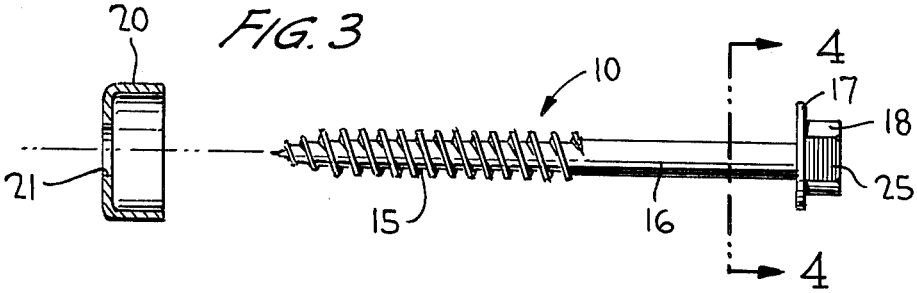
FIG. 3 is a side view of the screw and the cup washer in cross-section spaced from the screw.

Referring now to FIG. 3, the screw 10 can be seen to be a lag-type screw with threads 15 and a shank portion 16. An integral washer 17 and head 18 are formed at the end of the screw.

A cup washer 20 forms an important part of the screw lock assembly (see also FIG. 2). The cup washer is positioned in an enlarged portion of the aperture of the inside frame member 12, as shown in FIG. 2 also. The screw 10 passes through the opening 21 in the cup washer 20.

The cup washer fits within the enlarged portion of the aperture with a tight fit. This tight fit means that the frictional engagement between the outer circumference of the washer and the inside of the aperture prevents rotation. Also, unauthorized grasping of the washer by pliers or other tools is effectively prevented. Furthermore, with the cup washer recessed, access cannot be gained to remove the washer by cutting since the outer rim is flush with the face of the frame member 12 (FIG. 2).

The head of the screw is basically cylindrical with a single flattened side 25, as best shown in FIG. 3. This flat side covers substantially a ninety degree portion of the cylinder. That is, a chord formed by the flattened side extends across substantially ninety degrees of the cylinder.

Figure 6:
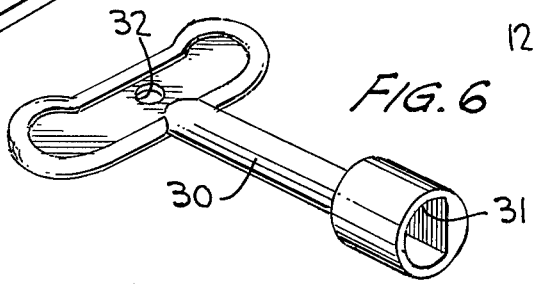
FIG. 6 is a perspective view of a key for driving the locking screw of the preferred embodiment.

FIG. 6 shows the key 30 having a driving opening 31 corresponding to the tamper-proof outline of the head 18. A hole 32 in the wing handle of the key provides a convenient means for allowing the key to hang near the window for ready access by the occupants of the building when required.

Figure 4:
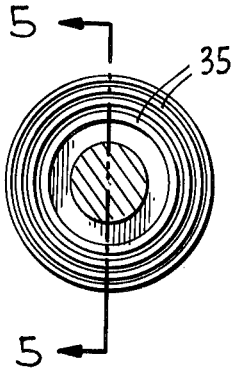
FIG. 4 is a cross-sectional view taken along line 4—4 of FIG. 3 showing the underside of the flat washer.
Figure 5:
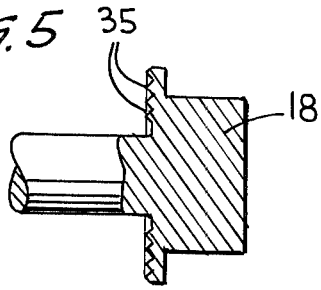
FIG. 5 is an enlarged cross-sectional view of the integral head and washer of the bolt.

FIG. 4 shows the underneath side of the integral flat washer 17, and this forms an important aspect of the present invention. A plurality of circular ridges 35 are formed in order to more securely engage the face of the cup washer (see FIG. 3). These concentric ridges 35 (see FIG. 5) provide areas of concentrated force for biting into the adjacent metal of the cup washer 20. These ridges are roughened during the manufacturing process in order to form a locking relationship as the metal binds when the screw 10 is tightened down fully, as shown in FIG. 2.

Because of the concentration of force, the frictional engagement is increased over what would normally occur with mating flat surfaces. Thus, an unauthorized person attempting to turn the screw to remove it from the locked position will have extreme difficulty in overcoming the frictional engagement necessary to start the screw turning. This feature, coupled with the recess of the head within the cup washer 20 provides a substantial increased security for my screw lock assembly.

Figure 7:
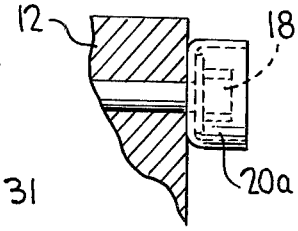
FIG. 7 is a partial view showing the alternative embodiment with the cup washer on the face of the frame member of the window.

The embodiment of FIG. 7 may be used if for some reason the enlarged portion of the aperture on the inside window cannot be made. The locking feature, as well as the anti-access features afforded by the cup washer **20*a*** are still provided.

As an added feature, with the screw 10 mounted along the side of the frame members 11, 12, the locking device would normally be hidden from view by drapes, curtains or shutters. Also when positioned in this location, an extra spaced aperture 40 (see FIG. 1) may be provided to allow alignment of the aperture in the frame member 12 so as to hold the sash $S_2$ in a slightly open position. If two screws 10 are used, one on each side, a highly effective weather seal is formed by clamping the frame members 11, 12 tightly together. Two locks are also most effective when a window is to be permanently sealed, such as is desirable with window air conditioner units installed in the window.

In summary, it can be seen that a simple, yet highly effective window lock has been provided. This lock is primarily intended for supplemental use during periods of extended absence from a home or other building. Yet, with the key 30 readily available, the lock can be quickly removed in an emergency for safe escape from fire or other hazards. During periods when not in use for any reason, the screw 10 is simply backed out half way so that the aperture in frame member 11 is not engaged, or the screw may be removed completely.

An important feature of the lock assembly, as pointed out above, is the locking means that hinders the burglar beyond his safe time, and thus effectively prevents, unauthorized removal of the screw. The countersunk cup washer 20, the tamper-proof head 18 and the locking ridges 35 on the integral washer 17 collectively contribute to this feature. The assembly is low cost, easy to install and operate once installed.

In this disclosure, there is shown and described only the preferred embodiments of the invention, but, as aforementioned, it is to be understood that the invention is capable of use in various other combinations and environment and is capable of changes or modifications within the scope of the inventive concept as expressed herein.

What is claimed is:

1. A screw lock assembly for windows, wherein the windows include abutting frame members in the closed position, comprising drilled aligned apertures at at least one position along said frames, said aligned apertures being open only at one end adjacent the inside of said windows and closed toward the outside, a screw for insertion into said apertures from the inside directly engaging said apertures to lock said windows together and draw said frame members together into face-to-face contact, a head and integral flat washer on said screw, a cup washer positioned adjacent the open end of the apertures, said apertures at the open end having a substantially enlarged portion, said cup washer being positioned in said enlarged portion with a tight frictional fit to prevent turning of the same, the head of said screw being recessed into said cup washer to limit accessibility to the head, and locking means formed over substantially the full interface between said washers to prevent unauthorized removal of said screw, said locking means comprising a plurality of curved ridges formed on the underside of said integral flat washer, said ridges frictionally engaging the adjacent face of said cup washer and binding against said washer prevented from rotating by the frictional fit in said enlarged portion.

* * * * *